US009700932B2

(12) United States Patent
Yang

(10) Patent No.: US 9,700,932 B2
(45) Date of Patent: Jul. 11, 2017

(54) WIRE-FORMING MECHANISM FOR SPRING MAKING MACHINE

(71) Applicant: PLUSPRINGS MACHINERY CO.,LTD, New Taipei (TW)

(72) Inventor: Ching-Fa Yang, New Taipei (TW)

(73) Assignee: PLUSPRINGS MACHINERY CO.,LTD, New Taipei (TW)

( * ) Notice: Subject to any disclaimer, the term of this patent is extended or adjusted under 35 U.S.C. 154(b) by 299 days.

(21) Appl. No.: 14/712,243

(22) Filed: May 14, 2015

(65) Prior Publication Data

US 2016/0332212 A1 Nov. 17, 2016

(51) Int. Cl.

*B21F 35/00* (2006.01)
*B21F 1/00* (2006.01)
*B21F 3/06* (2006.01)

(52) U.S. Cl.

CPC ..... *B21F 35/00* (2013.01); *B21F 1/008* (2013.01); *B21F 3/06* (2013.01)

(58) Field of Classification Search

CPC .... B21F 1/00; B21F 1/008; B21F 3/00; B21F 3/02; B21F 3/06; B21F 35/00
USPC ..... 140/103, 92.1
See application file for complete search history.

(56) References Cited

U.S. PATENT DOCUMENTS 3,245,433 A * 4/1966 Taylor, Jr. ..... B21F 1/00 72/369
4,843,861 A * 7/1989 Langley ..... B21F 1/008 72/306
7,107,806 B2 * 9/2006 Tsuritani ..... B21F 3/02 72/135
8,166,786 B2 * 5/2012 Speck ..... B21F 1/00 72/137
8,307,683 B2 * 11/2012 Jung ..... B21F 35/00 72/142
8,424,352 B2 * 4/2013 Jung ..... B21F 35/00 72/138

* cited by examiner

*Primary Examiner* — Teresa M Ekiert

(57) ABSTRACT

A wire-forming mechanism for spring making machine includes a base frame with two first sliding rail sets, and two wire-forming assemblies for independently performing a two-dimensional action. Each wire-forming assembly includes a movable base panel slidably mounted on one respective first sliding rail set and providing a second sliding rail set that extends in a perpendicular manner relative to the first sliding rail sets, a tool panel slidably mounted on the second sliding rail set and providing an L-shaped tool mount, one or multiple tools selectively mounted in the L-shaped tool mount, and two driving mechanisms for moving the movable base panel along one respective first sliding rail set and the tool panel along the second sliding rail set respectively.

4 Claims, 8 Drawing Sheets

WIRE-FORMING MECHANISM FOR SPRING MAKING MACHINE

BACKGROUND OF THE INVENTION

1. Field of the Invention

The present invention relates to spring making machine technology and more particularly, to a wire-forming mechanism for spring making machine, which uses two reversely arranged wire-forming assemblies for carrying two tools in L-shaped tool mounts at tool panels thereof selectively at different locations and angles, so that when one tool is moved back, the other tool is fed into the workpiece, accelerating the tool feeding and retracting speed.

2. Description of the Related Art

Many advanced spring making machines are known. For example, U.S. Pat. No. 8,166,786 B2 discloses a wire-forming machine, which comprises a machine frame, a wire feeder and a wire guide for transporting wire to a working area of the machine where the wire is processed by one or more tools. The tools are affixed on a tool plate on the machine frame and around a recess formed in the plate. A wire is fed through the recess to the working area of the machine. The tool plate is fitted on a second plate and is displaceable along a first direction (x) relative to the second plate, while the second plate is displaceable along a second direction (y) relative to the machine plate. Both directions (x, y) have an inclination of 45° each to the vertical normal axis of the wire-forming machine and are perpendicular to each other. According to this prior art design, all tools are affixed on the tool plate. When changing the operating tool, the originally used tool must be retracted prior to feeding of another tool, preventing the originally used tool from impacting the wire guide. Thus, the tool moving stroke is prolonged. Further, the space for tool replacement is limited, complicating the tool replacement operation.

SUMMARY OF THE INVENTION

The present invention has been accomplished under the circumstances in view. It is therefore the main object of the present invention to provide a wire-forming mechanism for spring making machine, which uses two reversely arranged wire-forming assemblies for carrying two tools in tool panels thereof, so that when one tool is moved back, the other tool is fed into the workpiece, accelerating the tool feeding and retracting speed.

It is another object of the present invention to provide a wire-forming mechanism for spring making machine, which has the two L-shaped tool mounts at the two tool panels of the two wire-forming assemblies arranged reversed to each other so that one L-shaped tool mount exhibits an L shape and the other L-shaped tool mount exhibits an inverted L shape, and the tools can be selectively mounted in the L-shaped tool mounts at different locations and angles.

It is still another object of the present invention to provide a wire-forming mechanism for spring making machine, which has the two L-shaped tool mounts of the two wire-forming assemblies thereof so arranged with the respective L-shaped interior angles of the two L-shaped tool mounts facing toward each other in an oblique manner so that a large accommodation space is defined between the tool mounts for the mounting of tools in a conveniently replaceable manner.

To achieve these and other objects of the present invention, a wire-forming mechanism for spring making machine comprises a base frame and two independently operable wire-forming assemblies. Each wire-forming assembly comprises a movable base panel, a tool panel, at least one tool and two driving mechanisms. The movable base panel is slidably mounted on one respective first sliding rail set of the base frame, comprising a second sliding rail set located at an outer side thereof. The second sliding rail set extends in a perpendicular relationship with the first sliding rail sets of the base frame. The movable base panel is connected to one driving mechanism and controlled by the respective driving mechanism to move along the respective first sliding rail set. The tool panel is slidably mounted on the second sliding rail set, comprising an L-shaped tool mount for holding the at least one tool. The tool panel is connected to the other driving mechanism and controlled by the respective driving mechanism to move along the second sliding rail set of the movable base panel.

Further, the L-shaped tool mounts of the tool panels of the two wire-forming assemblies are arranged reversed to each other, respectively exhibiting an L shape and an inverted L shape. The two L-shaped tool mounts are so arranged with respective L-shaped interior angles thereof facing toward each other in an oblique manner.

DETAILED DESCRIPTION OF THE PREFERRED EMBODIMENT

Figure 1:
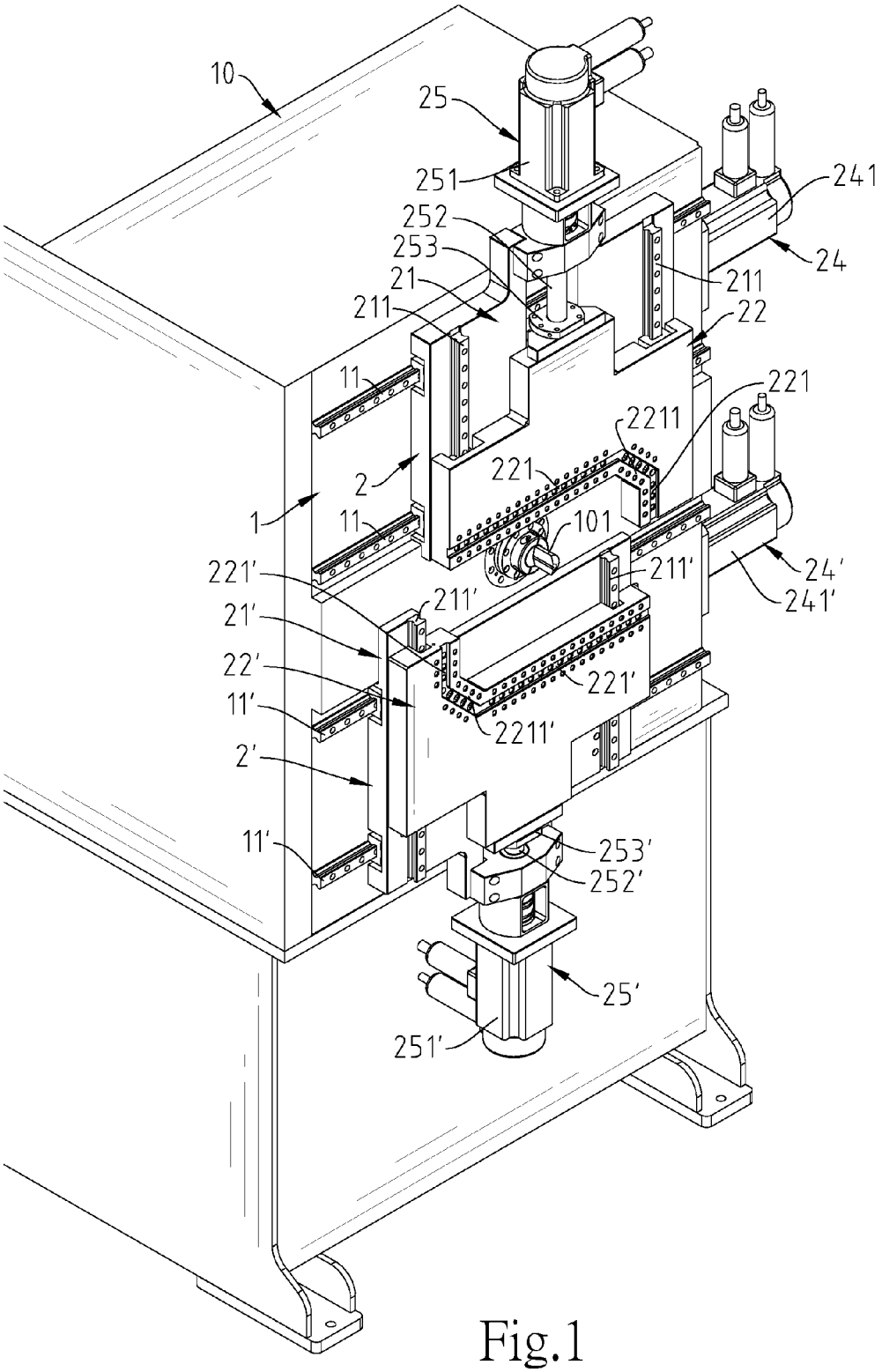
FIG. 1 is an oblique top elevation of a spring making machine equipped with a wire-forming mechanism in accordance with the present invention.
Figure 2:
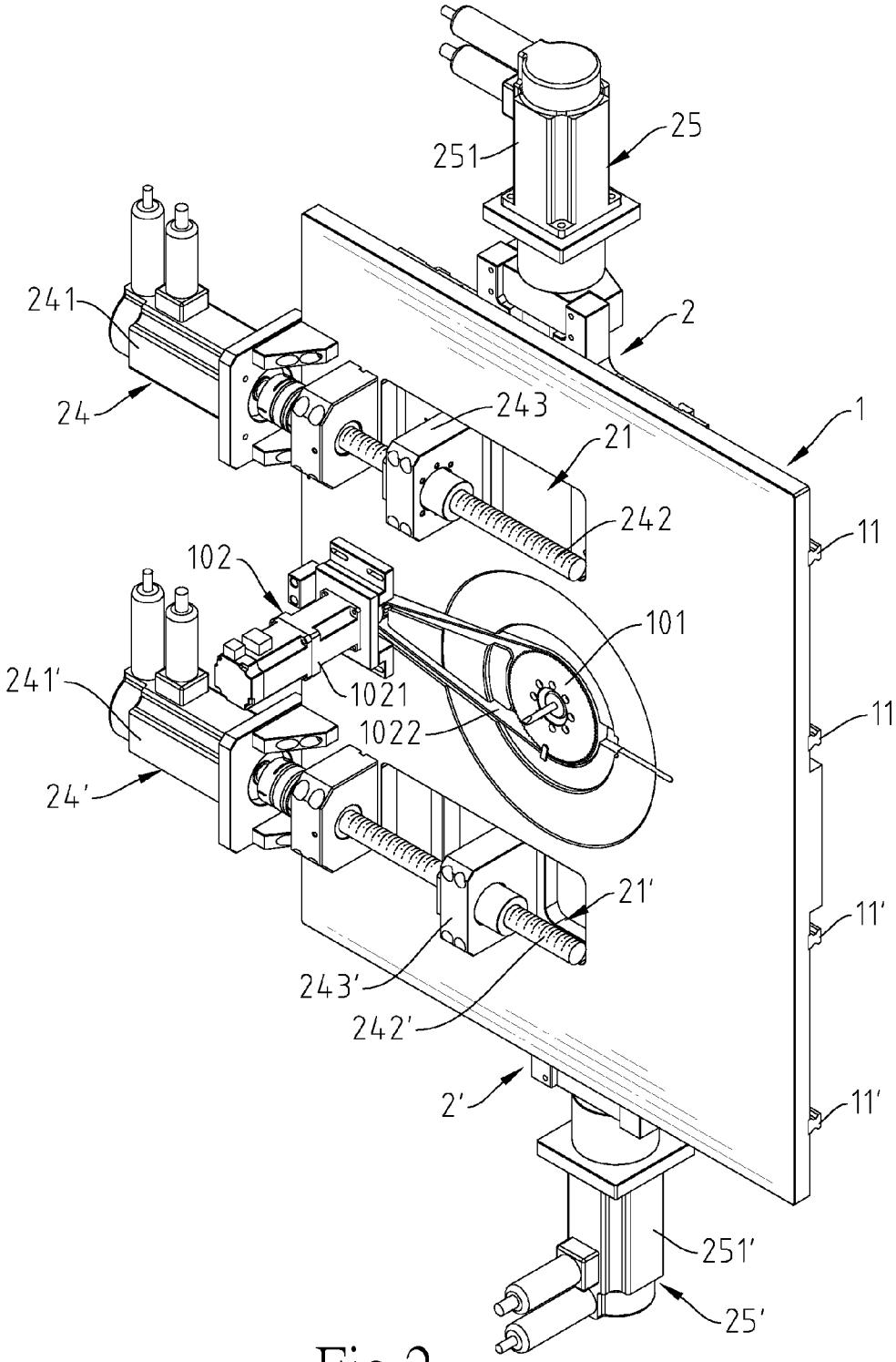
FIG. 2 is an oblique top elevation, in an enlarged scale, of a part of the spring making machine shown in FIG. 1.
Figure 3:
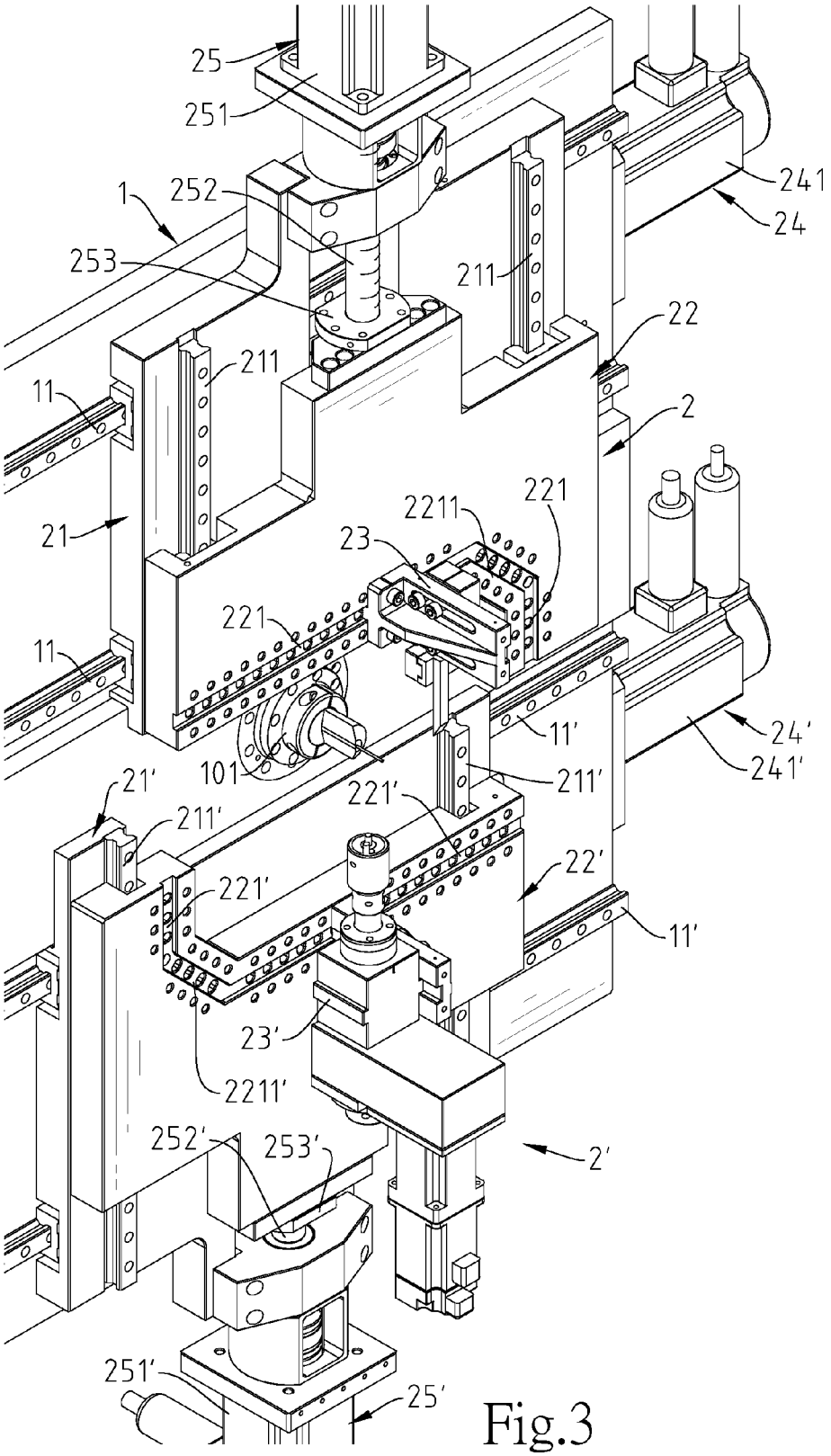
FIG. 3 is an oblique top elevation of the wire-forming mechanism in accordance with the present invention.

Referring to FIGS. 1 and 2, a spring making machine comprises a machine body 10 having mounted thereon a wire guide 101 and a rotator 102. The rotator 102 comprises a servo motor 1021, and a transmission belt 1022 coupled between the servo motor 1021 and the wire guide 101 and driven by the servo motor 1021 to rotate the wire guide 101 within a predetermined angle. The machine body 10 further comprises a power system, a central processing unit, a control system, power drive means, transmission means, etc. As the machine body 10 is not in the scope of the present invention, no further detailed description in this regard will be necessary.

Referring to FIGS. 1-5, a wire-forming mechanism in accordance with the present invention is installed in the aforesaid machine body 10. The wire-forming mechanism comprises a base frame 1, and two opposing wire-forming assemblies 2,2' that can independently perform a two-dimensional action.

The base frame 1 comprises two first sliding rail sets 11,11' located at an outer side thereof. The two opposing wire-forming assemblies 2,2' are respectively mounted on the first sliding rail sets 11,11' of the base frame 1. Each wire-forming assembly 2,2' comprises a movable base panel 21,21', a tool panel 22,22', at least one tool 23,23' and two driving mechanisms 24,25,24',25'. The two movable base panels 21,21' are respectively slidably mounted on the first sliding rail sets 11,11' of the base frame 1. Each movable base panel 21,21' comprises a second sliding rail set 211,211' located at an outer side thereof. The second sliding rail sets 211,211' extend in a perpendicular relationship with the first sliding rail sets 11,11' Further, the movable base panels 21,21' are respectively coupled to the driving mechanisms 24,24', and controlled by the respective driving mechanisms 24,24' to move along the respective first sliding rail sets 11,11' of the base frame 1. As illustrated in FIG. 2, each driving mechanism 24,24' comprises a servo motor 241,241', a lead screw 242,242', and a screw seat 243,243' affixed to the associating movable base panel 21,21'. Operating the servo motor 241,241' can rotate the lead screw 242,242', causing movement of the screw seat 243,243' and the associating movable base panel 21,21' axially along the respective lead screw 242,242'.

Figure 4:
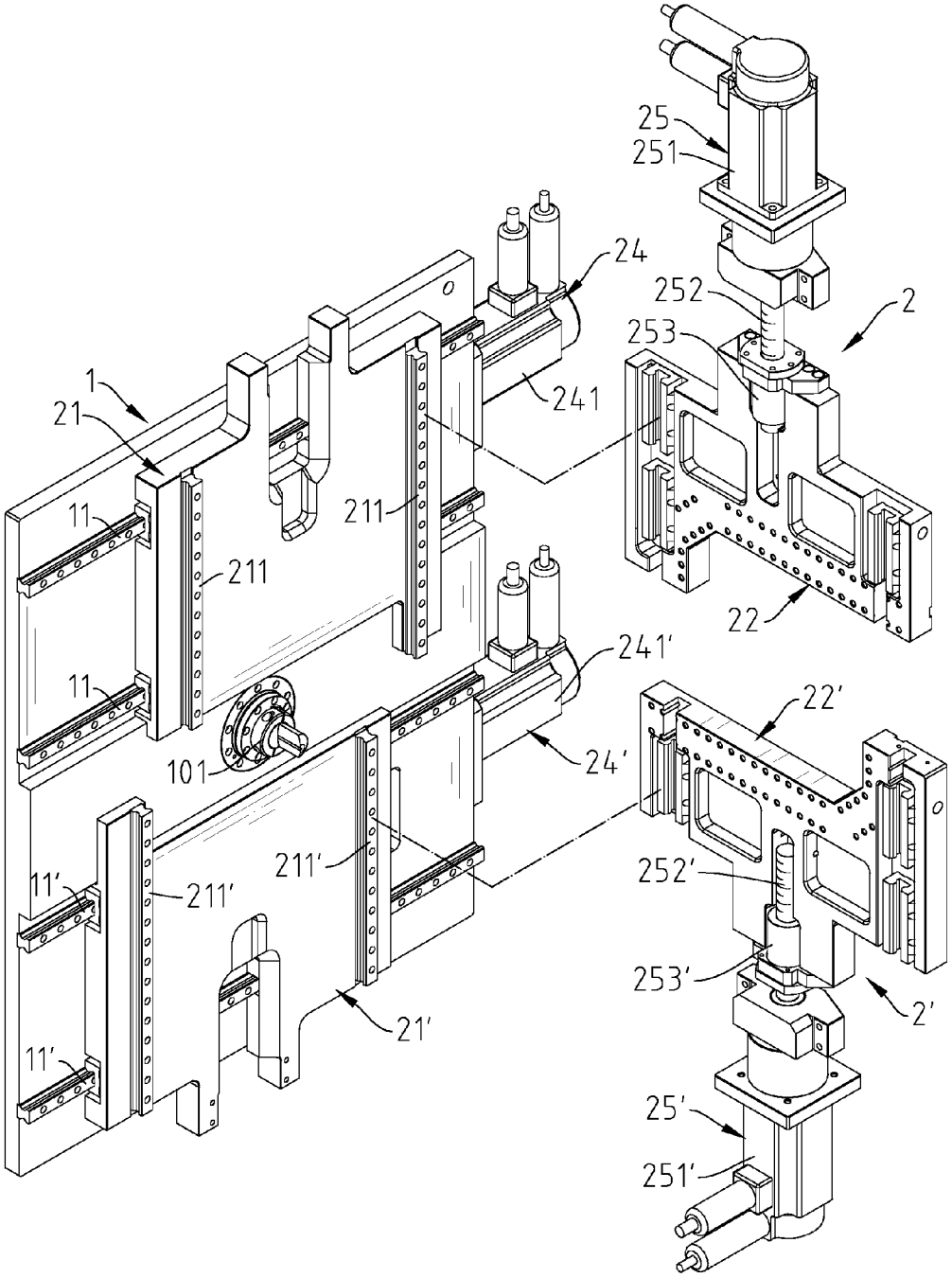
FIG. 4 is an exploded view of the wire-forming mechanism in accordance with the present invention.
Figure 5:
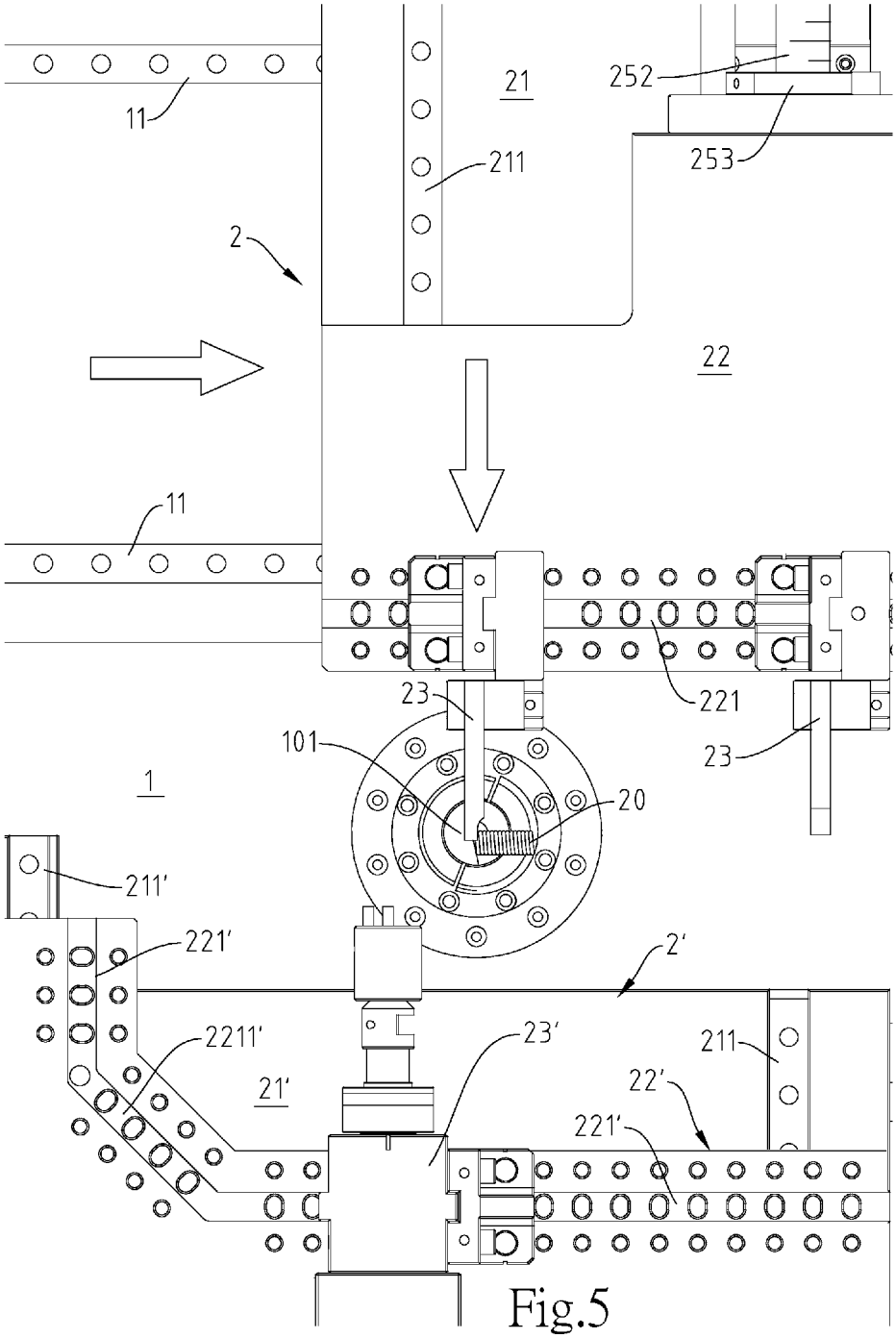
FIG. 5 is a schematic drawing illustrating an operation status of the wire-forming mechanism in accordance with the present invention.
Figure 6:
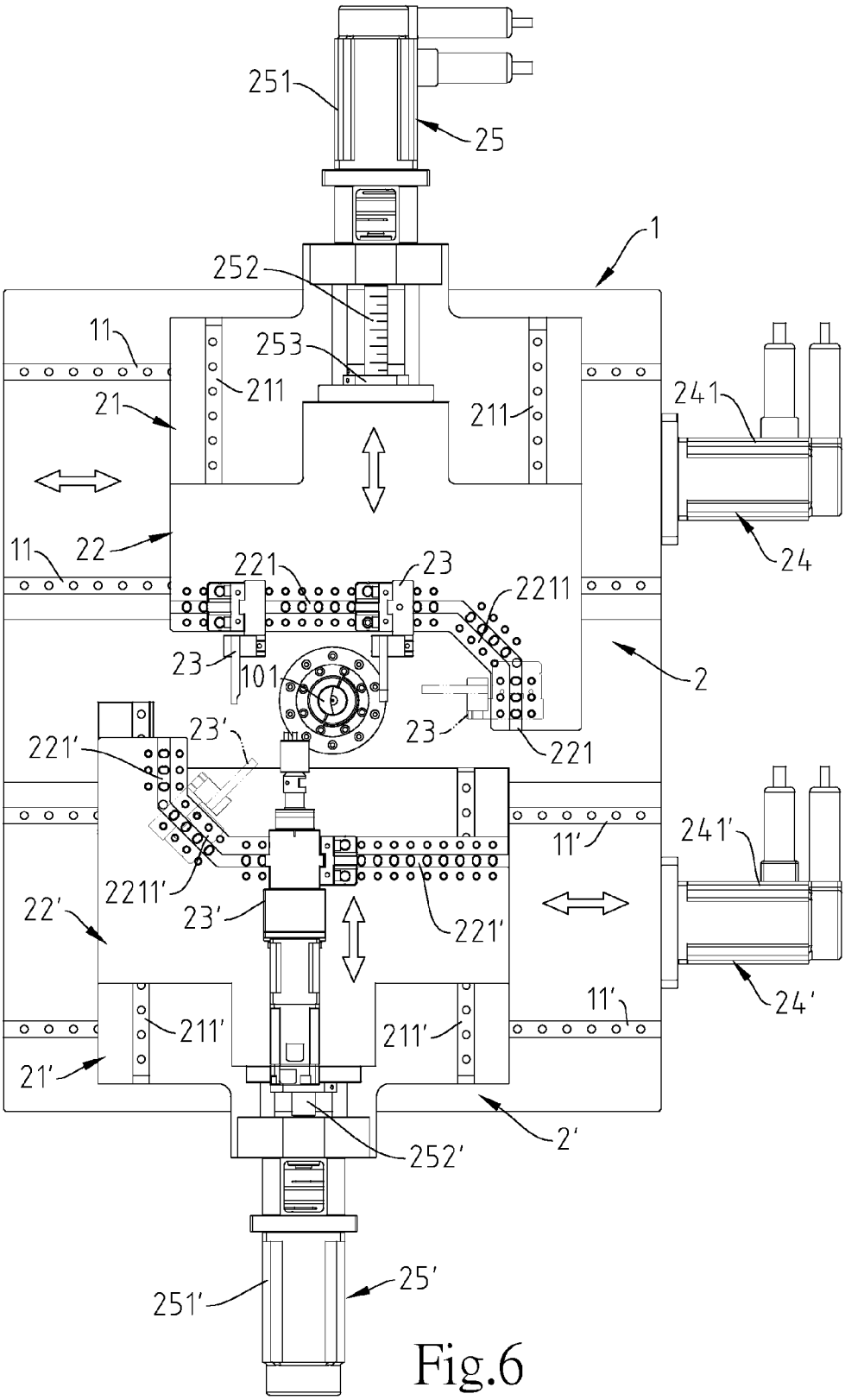
FIG. 6 is a schematic applied view of the present invention, illustrating different tools mounted in the wire-forming mechanism.
Figure 7:
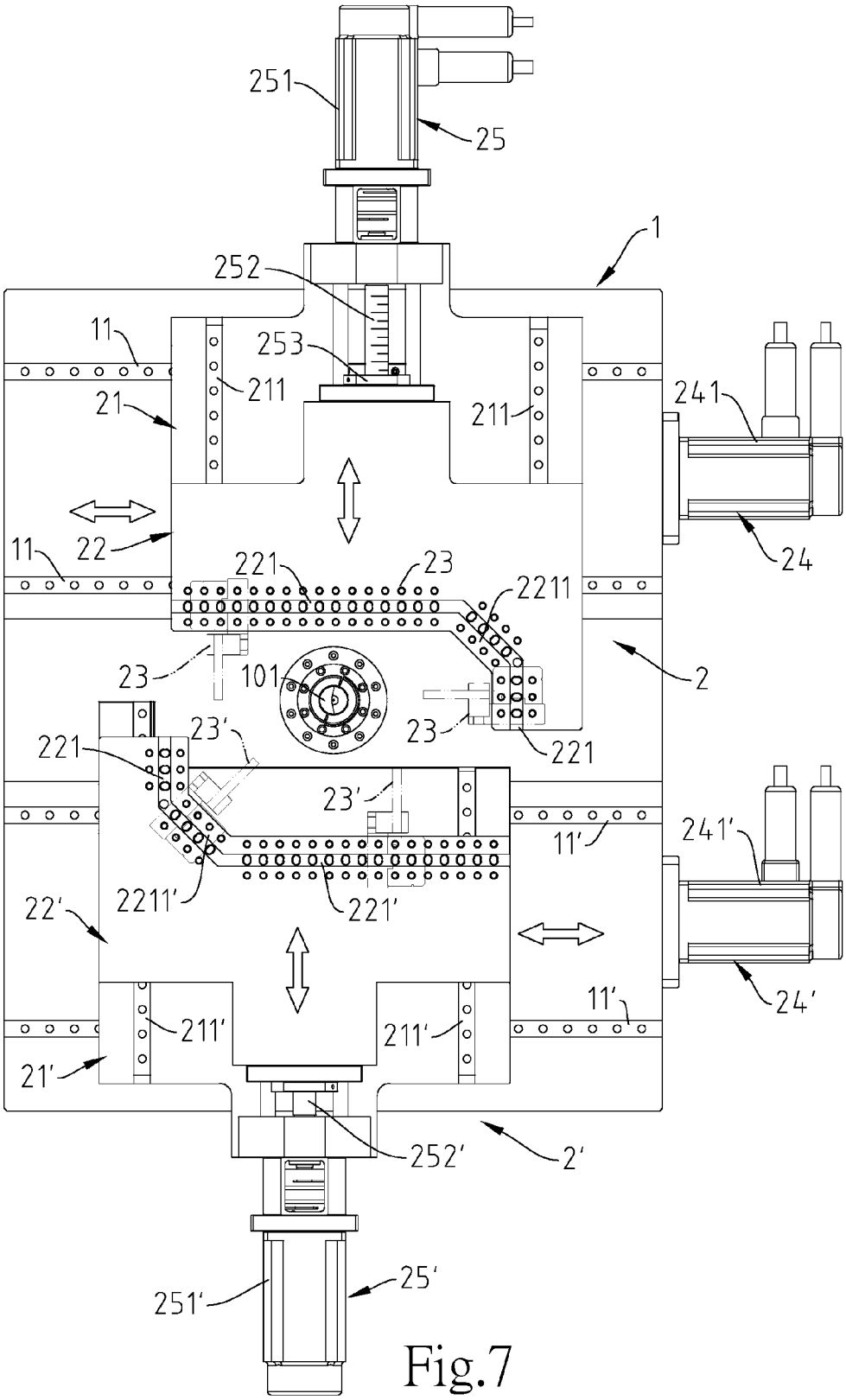
FIG. 7 is another schematic applied view of the present invention, illustrating different tools mounted in the wire-forming mechanism.

As illustrated in FIGS. 1-5, the tool panels 22,22' of the two wire-forming assemblies 2,2' are respectively slidably mounted on the second sliding rail sets 211,211' of the associating movable base panels 21,21', each comprising an L-shaped tool mount 221,221' for the mounting of the respective tool 23,23'. Further, the tool panels 22,22' are respectively connected to the driving mechanisms 25,25', and drivable by the respective driving mechanisms 25,25' to vmove along the respective second sliding rail sets 211,211' of the respective movable base panels 21,21'. As illustrated in FIG. 4, each driving mechanism 25,25' comprises a servo motor 251,251', a lead screw 252,252', and a screw seat 253,253' affixed to the associating tool panel 22,22'. Operating the servo motor 251,251' can rotate the lead screw 252,252', causing movement of the screw seat 253,253' and the associating tool panel 22,22' axially along the respective lead screw 252,252'.

Referring to FIGS. 3-7, the L-shaped tool mounts 221, 221' of the tool panels 22,22' of the two wire-forming assemblies 2,2' are arranged reversed to each other, respectively exhibiting an L shape and an inverted L shape. The two L-shaped tool mounts 221,221' are so arranged with the respective L-shaped interior angles thereof facing toward each other in an oblique manner so that a large accommodation space is defined between the tool mounts 221,221' for the mounting of tools 23,23' in a conveniently replaceable manner. Further, the aforesaid two L-shaped tool mounts 221,221' each comprise an oblique side block 2211,2211' located at the L-shaped interior angle thereof. This oblique side block 2211,2211' reinforces the structural strength of the respective tool mount 221,221', and also provides an oblique angle for the mounting of the tool 23,23'.

Further, as illustrated, the tool panel 22,22' furthert comprises a plurality of screw holes located in the tool mount 221,221' and the oblique side block 2211,2211' for the fastening of screws to affix different tools 23,23'. In the application examples shown in FIGS. 6 and 7, tools 23,23' are mounted in the L-shaped tool mounts 221,221' and the oblique side blocks 2211,2211' at different locations and angles.

Referring to FIGS. 3-7, different tools 23,23' are adapted to provide different functions, such as guiding, positioning, rotating, curving or cutting, and respectively carried to move by the respective tool panels 22,22'. The tool panels 22,22' are respectively carried to move by the respective movable base panels 21,21'. Therefore, the loaded tools 23,23' can be moved in two axial directions within a predetermined range, thereby making springs 20 subject to predetermined specifications, as shown FIG. 5. Because the wire-forming mechanism of the invention provides two wire-forming assemblies 2,2', the two wire-forming assemblies 2,2' can be moved at the same time after one tool 23,23' completed an operation. At this time, one tool 23,23' is moved back, and the other tool 23,23' is fed into the workpiece, and thus, the tool feeding and retracting speed can be significantly accelerated.

Figure 8:
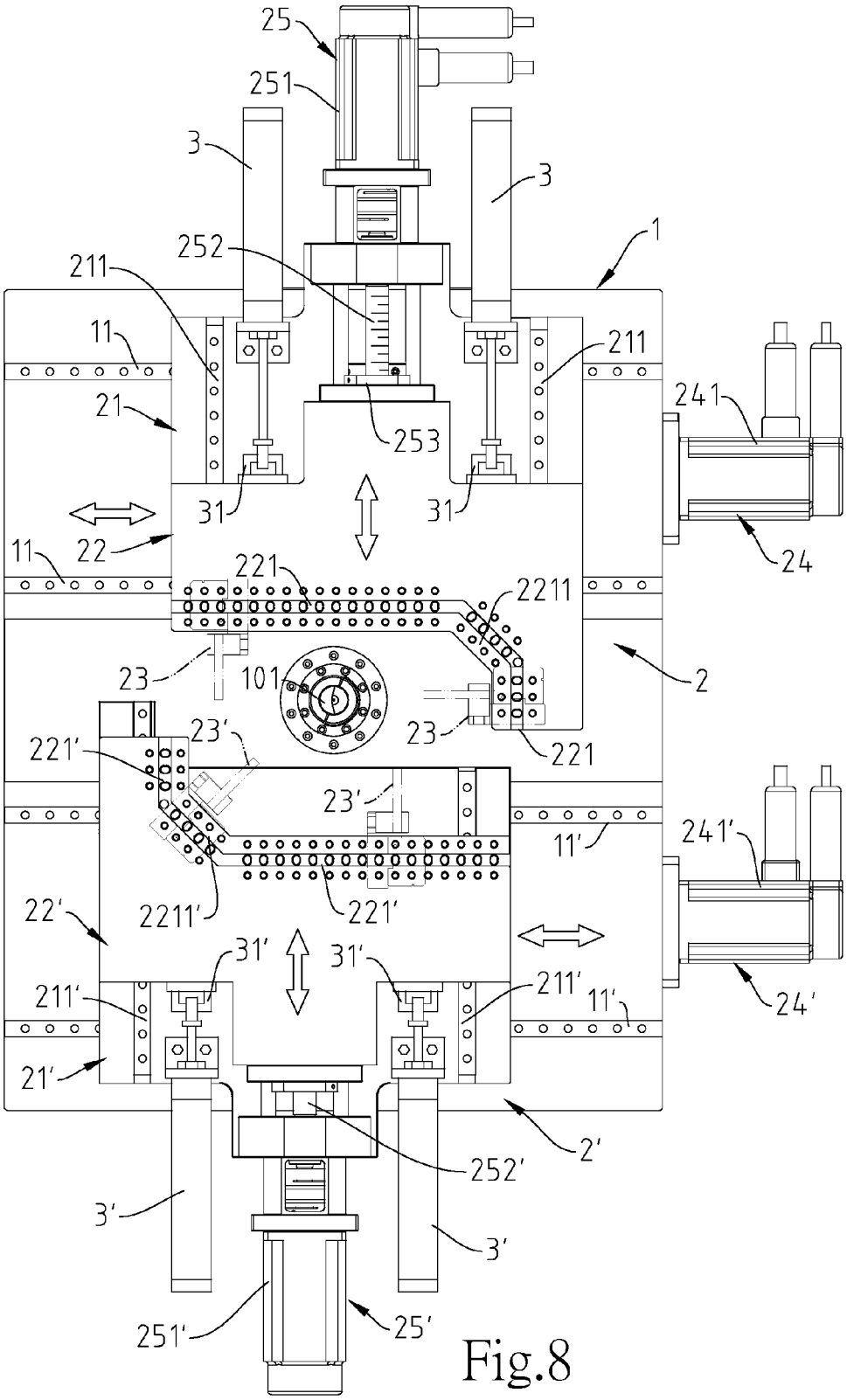
FIG. 8 is a schematic drawing of the present invention, illustrating the wire-forming mechanism equipped with supplementary air cylinder.

Referring to FIG. 8, the tool panels 22,22' of the two wire-forming assemblies 2,2' have supplementary air cylinders 3,3' connected thereto. These supplementary air cylinders 3,3' are fixedly mounted at the base frame 1 with the piston rods 31,31' thereof respectively connected to the tool panels 22,22'. The reciprocating operation of the supplementary air cylinders 3,3' is designed to be implemented in a synchronous manner relative to the movement of the tool panels 22,22' to share the pressure that is applied to the tool panels 22,22', enabling the tool panels 22,22' to be moved with less resistance.

What the invention claimed is:

1. A wire-forming mechanism used in a spring making machine, comprising:

a base frame comprising two first sliding rail sets located at an outer side thereof; and two wire-forming assemblies respectively mounted on said first sliding rail sets of said base frame for independently performing a two-dimensional action, each said wire-forming assembly comprising a movable base panel, a tool panel, at least one tool and two driving mechanisms, said movable base panel being slidably mounted on one respective said first sliding rail set of said base frame, said movable base panel comprising a second sliding rail set located at an outer side thereof, said second sliding rail set extending in a perpendicular relationship with said first sliding rail sets of said base frame, said movable base panel being connected to one said driving mechanism and controlled by the respective said driving mechanism to move along the respective said first sliding rail sets of said base frame, said tool panel being slidably mounted on said second sliding rail set of said movable base panel and comprising an L-shaped tool mount for holding said at least one tool, said tool panel being connected to the other said driving mechanism and controlled by the respective said driving mechanism to move along the respective said second sliding rail set of said movable base panel.

2. The wire-forming mechanism as claimed in claim 1, wherein said L-shaped tool mounts of said tool panels of said two wire-forming assemblies are arranged reversed to each other, respectively exhibiting an L shape and an inverted L shape, said two L-shaped tool mounts being so arranged with respective L-shaped interior angles thereof facing toward each other in an oblique manner.

3. The wire-forming mechanism as claimed in claim 1, wherein said L-shaped tool mounts of said tool panels of said two wire-forming assemblies each comprise an oblique side block located at the L-shaped interior angle thereof.

4. The wire-forming mechanism as claimed in claim 1, wherein each said wire-forming assembly further comprises a supplementary air cylinder fixedly mounted on the associating said base frame, said supplementary air cylinder comprising a piston rod connected to the associating said tool panel.

* * * * *